United States Patent [19]

Soffge

[11] 3,962,747

[45] June 15, 1976

[54] INSTALLATION FOR ANCHORING THE RAMP ENDS OF BRIDGES

[75] Inventor: Friedhelm Soffge, Kornwestheim, Germany

[73] Assignee: Dr. -Ing. H.c.F. Porsche Aktiengesellschaft, Germany

[22] Filed: Jan. 27, 1975

[21] Appl. No.: 544,270

[30] Foreign Application Priority Data

Jan. 25, 1974 Germany ..... 2403495

[52] U.S. Cl. ..... 14/69.5

[51] Int. Cl.[2] ..... E01D 15/12

[58] Field of Search ..... 14/71, 1, 127, 72

[56] References Cited

UNITED STATES PATENTS

| | | | |
|---|---|---|---|
| 1,286,346 | 12/1918 | Kirwan | 14/72 |
| 1,821,734 | 9/1931 | Viche | 14/72 |
| 2,436,467 | 2/1948 | Winter | 14/71 X |
| 3,323,157 | 6/1967 | Vaugoyeau | 14/27 X |
| 3,499,179 | 3/1970 | Weld | 14/27 |

*Primary Examiner*—Nile C. Byers

*Attorney, Agent, or Firm*—Craig & Antonelli

[57] ABSTRACT

An anchoring arrangement for the ramp ends of a bridge structure wherein an anchoring plate is provided and secured to the ramp ends by at least one tensioning device. The anchoring plate is provided with a plurality of openings each of which includes a ridge or bulge portion projecting from the surface of the anchoring plate which faces the support surface for the ramp ends to form a claw-like structure for firmly gripping the support surface. A layer of material may be provided between the upper surface of the anchoring plate and a lower surface of the ramp end to increase the friction between the anchoring plate and ramp end.

26 Claims, 3 Drawing Figures

INSTALLATION FOR ANCHORING THE RAMP ENDS OF BRIDGES

The present invention relates to an anchoring arrangement for bridge structures, especially for quick-placing tank bridges on a shore bank or the like in which an anchoring plate is provided with projecting gripping portions or bulges.

An arrangement for securely and relatively slidelessly anchoring ramp ends of a bridge structure at any support point, for example, a shore bank, is disclosed in U.S. Pat. No. 3,323,157 wherein the ramp ends of the bridge structure are provided on the underside or groundfacing side thereof with claw-like feet which burrow themselves into the shore bank at the bridge site.

Additionally, French Pat. No. 1,424,944, discloses a ramp end construction the underside of which is provided with insertable friction plates having a ribbed surface for gripping the shore bank or ground surface.

A disadvantage of the aforementioned prior art constructions lies in the fact that such constructions are compact and constructed of considerably heavy structural material and can only be assembled or disassembled at a considerable expense.

In the case of a quick-placing tank bridge, which consists of a plurality of individual parts, and which, for example, is removed in a folded position from a truck or the like, the use of the compact and heavy anchoring constructions of the prior art may hinder the removal of the bridge from the truck and subsequent assembly thereof.

The underlying problems are solved according to the present invention in that an anchoring plate, preferably constructed of a thin sheet metal material, is provided and secured to the ramp ends with the anchoring plate being provided with a plurality of projecting claw-like elements which engage the shore bank or the like.

Accordingly, it is an object of the present invention to provide a ramp end anchoring arrangement for bridge structures which avoids the shortcomings and drawbacks encountered in the prior art.

Another object of the present invention resides in an improved bridge ramp and anchoring arrangement by which the ramp ends, in a simple manner, may be anchored safely and firmly on all bridge support sites.

According to one feature of the present invention, an anchoring plate is provided which is penetrated by a plurality of openings the rims of which protrude from the lower surface of the anchoring plate to form claws facing the ground or shore bank. By this arrangement a firm anchoring between the ramp ends of the bridge structure and the support site is created in a simple and advantageous manner.

According to a further feature of the present invention, the anchoring plate is provided at its surface portion facing the bottom surface of the ramp ends with an elevated layer of material for increasing the friction between the ramp ends of the bridge and anchoring plate thereby creating a friction contact between the anchoring plate and ramp ends and also ensuring a secure and relatively slideless anchoring arrangement.

According to yet a further feature of the present invention, to facilitate a simple and rapid assembly and disassembly of the anchoring arrangement to and from the bridge structure, one or more tension devices are arranged at the lateral edges of the anchoring plate and are fastened at the ramp ends of the bridge structure.

According to the present invention, the tensioning devices are provided with a safety yoke mounted on an axle or shaft disposed in a cavity or recess formed at the edge of the anchoring plate. A safety pin structure is provided on the yoke and rests on a resilient shank or wall portion of the cavity or recess to maintain the yoke under a constant tension.

These and other objects, features and advantages of the present invention will become more obvious from the following description when taken in connection with the accompanying drawing which shows, for the purposes of illustration only, one embodiment of an anchoring arrangement for the ramp ends of a bridge structure in accordance with the present invention, and wherein.

Figure 1:
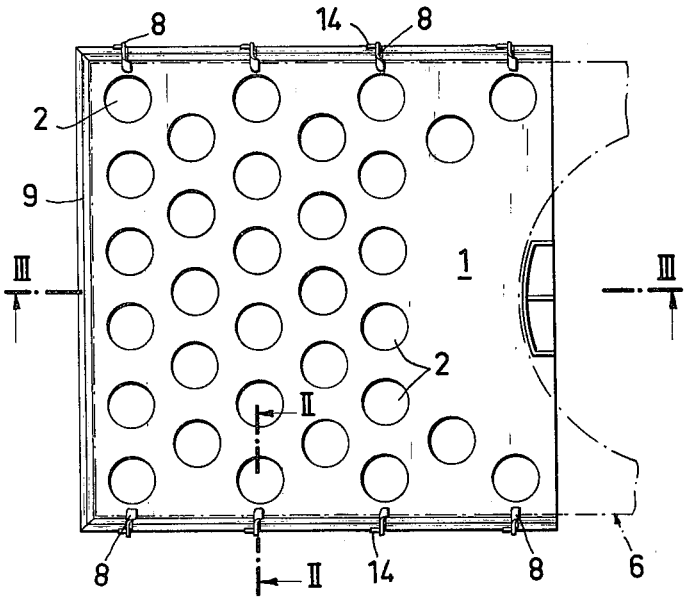
FIG. 1 is a plan view of an anchoring plate arrangement constructed in accordance with the present invention.

Referring now to the drawing wherein like reference numerals are used throughout the various views to designate like parts and more particularly to FIG. 1, a bridge, generally designated by the reference numeral 6, is provided with ramp ends 5 secured to an anchoring plate 1 by way of tensioning devices generally designated by the reference numeral 8.

The anchoring plate 1, preferably formed of a thin sheet metal material, is provided with a plurality of openings 2 which may be randomly arranged thereon. While the openings 2 are illustrated as being of a circular configuration, it is understood that such openings may be of any geometrical configuration.

Figure 3:
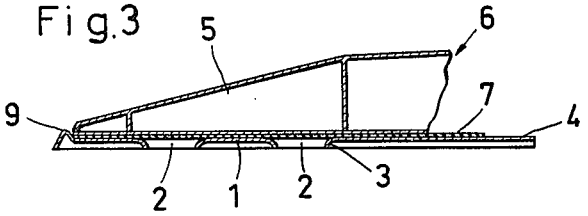
FIG. 3 is a cross-sectional view taken along line III—II of FIG. 1.
Figure 2:
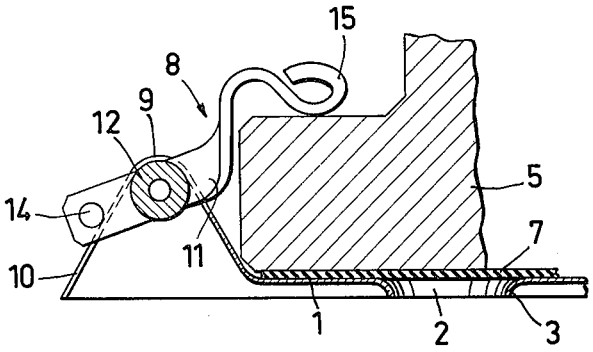
FIG. 2 is a partial cross-section view taken along line II—II of FIG. 1.

As shown in FIGS. 2 and 3, the openings 2 penetrate the anchoring plate 1 and protrude from the lower anchoring plate surface to form claw-like ridges or bulges which grip or entrench themselves in the ground or shore bank at the bridge site thereby resulting in a secure anchoring of the ramp end 5.

To minimize the relative displacement of the ramp end with respect to the anchoring plate 1, a friction increasing layer of material 7 is provided on the anchoring plate surface 4 facing the underside of the ramp end 5. Preferably the layer 7 consists of a rubber or rubber-like material; however, any other friction increasing material could also readily be utilized.

The anchoring plate 1 is provided with a roof-like raised rim or edge portion 9 which surrounds the periphery of the ramp end 5 and serves as a mounting for the tension devices 8. The edge portion 9 defines a recess or cavity which is open in the downward or ground direction with the cavity including a resilient shank or wall portion 10.

As shown most clearly in FIG. 2, the tensioning devices 8 include a safety yoke 11 supported on a shaft or axle 12 mounted in the recess or cavity of the rim or edge 9 of the anchoring plate 1. One end of the yoke 11 is provided with a head portion 15 which overlaps and engages a peripheral portion of the ramp end 5. The other end of the yoke 11 is provided with a safety pin structure 14 which is in engagement with the resilient shank or wall portion 10 of the edge 9 whereby the head portion 15 of the safety yoke 11 is maintained in engagement with the peripheral portion of the ramp end 5 under a constant tension thereby clamping the anchoring plate 1 to the ramp end 5.

By virtue of the resilient nature of the wall or shank portion 10, removal of the ramp end 5 from the anchoring plate 1 is effected by pressing or lifting the head portion 15 of the safety yoke 11 in the upward direction.

Since the anchoring plate 1 of the present invention consists preferably of a thin sheet metal material, a simple and easy anchoring of the ramp ends 5 of a bridge 6 is obtained which does not hinder the placing or assembly of the bridge 6. Additionally, a firm attachment of the anchoring plate 1 to the ramp end 5 is obtained by a simply constructed tensioning device 8.

While I have shown and described only one embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are encompassed by the scope of the appended claims.

I claim:

1. An arrangement for securing a ramp end of a bridge to a ramp end support surface, the arrangement comprising: anchoring plate means associated with the ramp end, gripping means provided on said anchoring plate means for firmly gripping the ramp end support surface to anchor the ramp end to the support surface, and tension means for releasably securing the anchor plate means to the ramp end, the anchoring plate means includes an upper surface portion facing the ramp end and a lower surface portion facing the ramp end support surface, said gripping means including a plurality of openings provided in said anchoring plate means having rim portions projecting from the lower surface of said anchoring plate means to form claw-like edges which engage the ramp end support surface.

2. An arrangement according to claim 1, wherein the bridge is a quick-placing tank bridge, and wherein the ramp end support surface is a shore bank or the like.

3. An arrangement according to claim 1 wherein means are provided on the anchoring plate means for mounting said tension means in proximity to the ramp end.

4. An arrangement according to claim 3, wherein said means for mounting said tension means includes a raised edge portion surrounding a peripheral portion of the ramp end.

5. An arrangement according to claim 4, wherein said raised edge portion defines a recess means opening in the direction of the ramp end support surface, said recess means including a resilient wall portion for providing a tension for said tension means.

6. An arrangement according to claim 5, wherein said tension means includes a shaft means rotatably mounted in said recess means, a safety yoke means mounted on said shaft means, and means provided on said safety yoke means for holding the safety yoke means under tension.

7. An arrangement according to claim 6, wherein said means for holding the safety yoke means under tension includes a pin means provided on said yoke means in engagement with said resilient wall portion of said recess means.

8. An arrangement according to claim 7, wherein means are provided for increasing the friction between the anchoring plate means and the ramp end.

9. An arrangement for securing a ramp end of a bridge to a ramp end support surface, the arrangement comprising: anchoring plate means associated with the ramp end, gripping means provided on said anchoring plate means for firmly gripping the ramp end support surface to anchor the ramp end to the support surface, the anchoring plate means includes an upper surface portion facing the ramp end and a lower surface portion facing the ramp end support surface, said gripping means including a plurality of openings provided in said anchoring plate means having rim portions projecting from the lower surface of said anchoring plate means to form claw-like edges which engage the ramp end support surface, the ramp end is provided with a lower surface portion overlying at least a portion of said upper surface portion of the anchoring plate means, and wherein means are disposed between the upper surface portion of the anchoring plate means and the lower surface portion of the ramp end for increasing the friction between the anchoring plate means and the ramp end.

10. An arrangement according to claim 9, wherein said means for increasing the friction consist of a layer of frictionincreasing material provided on the upper surface portion of the anchoring plate means.

11. An arrangement according to claim 10, wherein the friction-increasing material is a rubber or rubber-like material.

12. An arrangement according to claim 11, wherein tension means are provided for releasably securing the anchoring plate means to the ramp end.

13. An arrangement according to claim 12, wherein means are provided on the anchoring plate means for mounting said tension means in proximity to the ramp end.

14. An arrangement according to claim 13, wherein said means for mounting the tension means includes a raised edge portion surrounding a peripheral portion of the ramp end.

15. An arrangement according to claim 14, wherein said raised edge portion defines a recess means opening in the direction of the ramp end support surface, the recess means including a resilient wall portion for providing a tension for said tension means.

16. An arrangement according to claim 15, wherein said tension means includes a shaft means rotatably mounted in said recess means, a safety yoke means mounted on said shaft means, and means provided on said safety yoke means for holding the safety yoke means under tension.

17. An arrangement according to claim 16, wherein said means for holding said safety yoke means under tension includes a pin means provided on said yoke means in engagement with said resilient wall portion of said recess means.

18. An arrangement according to claim 17, wherein the anchoring plate means includes lateral edges, and wherein a plurality of tension means are provided and spaced along at least the lateral edges of said anchoring plate means.

19. An arrangement for securing a ramp end of a bridge to a ramp end support surface, the arrangement comprising: anchoring plate means associated with the ramp end, gripping means provided on said anchoring plate means for firmly gripping the ramp end support surface to anchor the ramp end to the support surface, and means are provided for increasing the friction between the anchoring plate means and the ramp end.

20. An arrangement according to claim 19, wherein said means for increasing the friction between the anchoring plate means and the ramp end consists of a layer of friction increasing material disposed between said anchoring plate means and the ramp end.

21. An arrangement according to claim 20, wherein at least one tension means is provided for releasably securing the anchoring plate means to the ramp end.

22. An arrangement according to claim 21, wherein said anchoring plate means is provided with a raised edge surrounding a peripheral portion of the ramp end, said raised edge defining a recess means opening in the direction of the ramp end support surface, the recess means including a resilient wall portion for providing a tension for said at least one tension means.

23. An arrangement according to claim 22, wherein said at least one tension means includes a shaft means rotatably mounted in said recess means, a yoke means mounted on said shaft means so as to be rotatable therewith, said yoke means including a first end engageable with a peripheral portion of the ramp end and a second end, means provided on said second end for engaging said resilient wall portion for maintaining said yoke means under tension.

24. An arrangement according to claim 19, wherein a plurality of tension means are provided and spaced along at least the lateral edges of the anchoring plate means, each of said tensioning means includes a shaft means rotatably mounted on said anchoring plate means, a yoke means mounted on said shaft means so as to be rotatable therewith, said yoke means including a first end engaged with a peripheral portion of the ramp end and a second end, and means provided on said second end for engaging a portion of said anchoring plate means for maintaining said yoke means under constant tension.

25. An arrangement according to claim 24, wherein said anchoring plate means is provided along a peripheral portion thereof with a raised edge to define a recess means opening in the direction of the ramp end support surface, each of said shaft means being rotatably mounted in said recess means, said recess means including a resilient wall portion, said second end of each of said yoke means engaging said resilient wall portion to maintain said yoke means under a constant tension.

26. An arrangement according to claim 25, wherein the ramp end is provided with a stepped portion along at least a portion of the periphery thereof, said first ends of each of said yoke means including a head portion overlying and engaging said stepped portion of the ramp end.

* * * * *